US008511012B2

(12) United States Patent
Scalzi

(10) Patent No.: US 8,511,012 B2
(45) Date of Patent: Aug. 20, 2013

(54) FRAME CONSTRUCTION FOR A FENESTRATION

(75) Inventor: Richard Scalzi, Sharon, MA (US)

(73) Assignee: Specialty Casings Company, Stoughton, MA (US)

( * ) Notice: Subject to any disclaimer, the term of this patent is extended or adjusted under 35 U.S.C. 154(b) by 198 days.

(21) Appl. No.: 12/851,298

(22) Filed: Aug. 5, 2010

(65) Prior Publication Data

US 2012/0031020 A1 Feb. 9, 2012

(51) Int. Cl.
*E06B 1/04* (2006.01)

(52) U.S. Cl.
USPC ..... 52/211; 52/204.53; 52/717.01

(58) Field of Classification Search
USPC ..... 52/58, 211, 204.53, 204.1, 204.61, 52/717.01, 656.5, 212
See application file for complete search history.

(56) References Cited

U.S. PATENT DOCUMENTS

| | | | | |
|---|---|---|---|---|
| 5,018,325 | A * | 5/1991 | Geen et al. | 52/211 |
| 5,022,204 | A * | 6/1991 | Anderson | 52/211 |
| 5,551,201 | A * | 9/1996 | Anderson | 52/717.05 |
| 5,625,992 | A * | 5/1997 | Strick et al. | 52/656.9 |
| 6,050,037 | A * | 4/2000 | Gifford | 52/211 |
| 6,125,605 | A * | 10/2000 | Young | 52/717.01 |
| 6,988,345 | B1 * | 1/2006 | Pelfrey et al. | 52/519 |
| 7,111,433 | B2 * | 9/2006 | Kerscher | 52/212 |
| 7,228,663 | B2 * | 6/2007 | Schiedegger et al. | 52/211 |
| 7,600,355 | B1 * | 10/2009 | Klein | 52/656.9 |
| 2012/0031023 | A1 * | 2/2012 | Scalzi et al. | 52/211 |

* cited by examiner

*Primary Examiner* — Branon Painter
(74) *Attorney, Agent, or Firm* — Wolf, Greenfield & Sacks, P.C.

(57) ABSTRACT

A window frame assembly for a window opening in which the assembly comprises a casing facing that covers the casing with a J-channel secured to the casing facing and defining an outwardly facing channel to receive bordering edges of siding material, and a casing molding having one longitudinal edge continuous with the casing facing and a second longitudinal edge outwardly and non-planar with the one longitudinal edge and engaging the J-channel. The casing molding of a color contrasting with either or both of the J-channel and casing facing.

23 Claims, 7 Drawing Sheets

FRAME CONSTRUCTION FOR A FENESTRATION

BACKGROUND OF INVENTION

The present invention relates to a trim assembly for framing windows, doors, or the like in a wall fenestration. Modern building constructions, particularly of homes and residents, ordinarily provide wall fenestrations in the building wall which receive windows or the like. A variety of window constructions may be inserted in these fenestrations, including simple window panes framed by sashes or casement windows or doors. In these installations, it has been common to provide a trim system to provide a finished look to the window by providing a frame about the window or door positioned in the opening. These trim assemblies function not only to provide an attractive finish, but also serve the dual function of providing means for interengaging siding or other covering materials which ordinarily are used to cover or finish the building walls.

It is also an object of the present invention to provide an improved trim kit or system for use in finishing a window or door casing in a manner that is attractive, easily installed, and adaptable to a wide range of sizes, shapes, and uses, including the adaptability of the unit for various color combinations.

It is therefore an object of the present invention to provide an inexpensive trim assembly kit which may be adapted for a wide range of building constructions for purposes of finishing fenestrations and window casings in a manner that is inexpensive, easy to install, attractive in appearance, and adapted for a wide range of designs, appearances and uses.

SUMMARY OF INVENTION

In the present invention, there is provided a system which includes a minimum number of trim members which may be readily formed of metal, wood, plastic components or other building material in a variety of shapes by extrusions or simple bending processes and cut to size or assembled on site. The trim assembly comprises an arrangement of a casing face, a casing molding that is continuous with the casing face, and a J-channel, with the J-channel, in turn, securing and supporting in fixed relation the various siding or other finishing materials used on the outside of the building construction. These three components, namely the casing face, casing molding and J-channel, may be selectively formed as two or three interchangeable components to permit use of different color trim elements for visual contrasts as well as for selective use of molding designs to enhance shadow effects of outdoor light on the assembled unit.

Each of these components, the casing face, the casing molding and the J-channel, may be extruded or otherwise formed of suitable material such as metal, vinyl, plastic or other material normally used in building constructions. The components may also be formed in length of sheets appropriately folded and bent to conform to the cross-sectional dimensions desired for the element. The various components may be made in various shapes to interlock one with the other and to simultaneously provide a selection of various finishes and appearances. If desired, one or more of the components may be painted or otherwise color formed to provide a contrasting color component to one or more of the elements forming this trim.

BRIEF DESCRIPTION OF DRAWINGS

These and other objects and advantages of the present invention will be more clearly understood when considered in conjunction with the accompanying drawings in which.

DETAILED DESCRIPTION OF INVENTION

Figure 1:
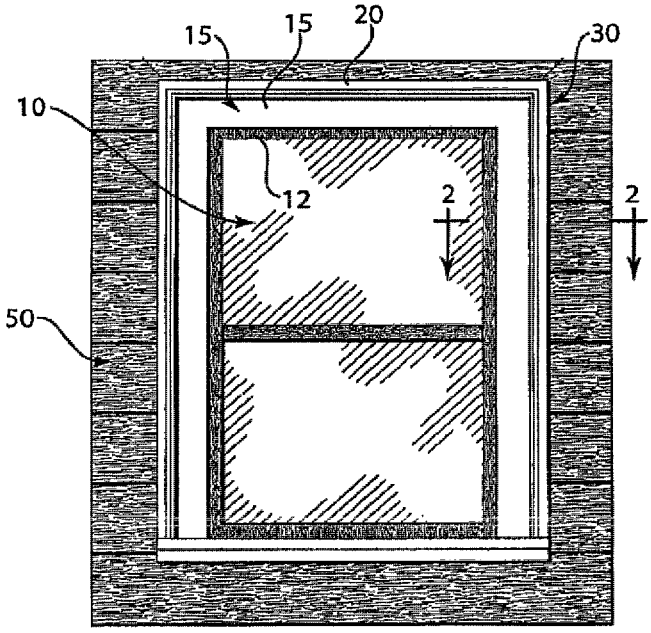
FIG. 1 is a plan elevational view of a window assembly embodying the present invention.

As noted, the present invention is directed primarily to a window, doors and other fenestrations treatment for residential and commercial buildings, but has other applications. In the specific embodiments illustrated, there is shown a window trim assembly designed primarily for a residential building in which the building wall may be conventionally formed with a window opening or fenestration in which a window 10 is positioned. The window 10 may be a wide range of designs including simple designs in which the window pane is framed by a sash 12 or by other casement type windows. The window is secured to the building construction which may comprise standard construction. For example, a wooden wall 14 supported by studs and framing (not shown) to form the shell of the building. The window opening is framed by a casing 15 which preferably extends about the sides and top of the opening and is finished by a sill suitably covered by a sill cover shown and further described in connection with FIGS. 6*a* through 7*c*. The window trim system comprises primarily a casing face 16, a casing molding 20 and a J-channel 30 interlocked and secured to the casing 15 as hereafter described. Finish siding material 50 (FIG. 5) positioned over the casing 15 is secured and fits into the J-shaped channel 30.

Figure 2:
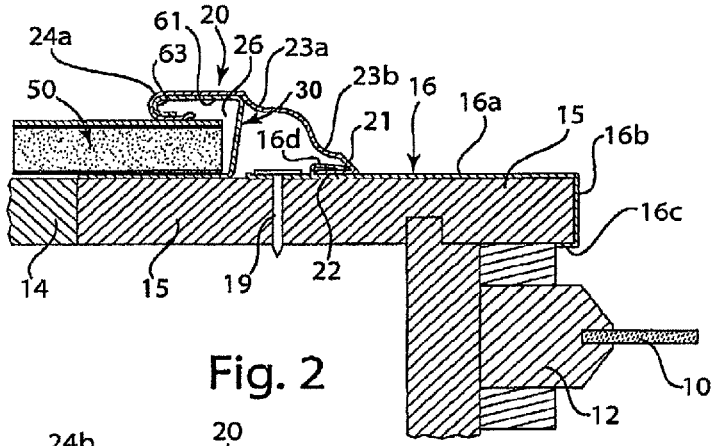
FIG. 2 is a fragmentary, cross-sectional detail taken along the lines 2-2 of FIG. 1.
Figure 3:
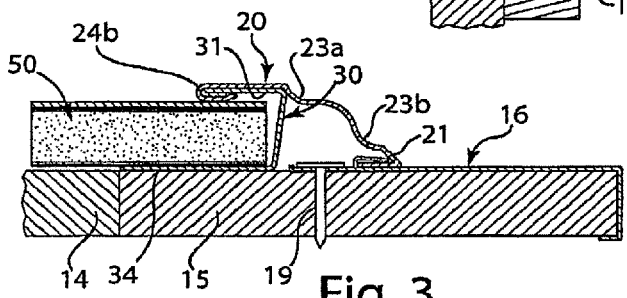
FIG. 3 is a cross-sectional detail of a modification of the preferred embodiment, also taken essentially along the line 2-2 of FIG. 1.

The casing face 16, as illustrated in FIGS. 2 and 3, may be formed by an elongated, metal plastic or other sheet or extrusions providing a facing web 16*a* that lies against the outer surface of the casing 15. An inwardly extending flange 16*b* terminating in a lip 16*c* closely conforming to and covering the end or border of the casing 15. Material for the casing face 16 may be formed initially of extruded lengths of plastic material or bent metal in varying lengths, as for example 20 feet long, which are then cut to size on site to the length of the sides and the upper end of the casing. The casing face 16 is suitably secured to the casing by suitable means such as nails 19 which extend through spaced holes in the web 16*a* of the casing face 16. (See also FIG. 8)

The window sill at the bottom of the window opening is similarly covered as illustrated in FIGS. 5-7*c*. In this arrangement, the sill cover 17 fits closely around a sill 17*a* (FIG. 6*a*). The sill cover includes an upper web 17*b* which extends close to the angled sill and terminates in a downwardly extending flange 17*c* which in turn is integral with the inwardly extending flange 17*d*, with the inwardly extending flange 17*d* terminating in a lip 17*e* that is secured to the wall 14 below the opening. The sill cover 17 may be secured to the sill by means of nails secured to the sill through openings 17*e*. The ends of the sill cover 17 may be closed by end caps 17*f* and 17*g* shown in FIGS. 7*a* and 7*c*.

Figure 4:
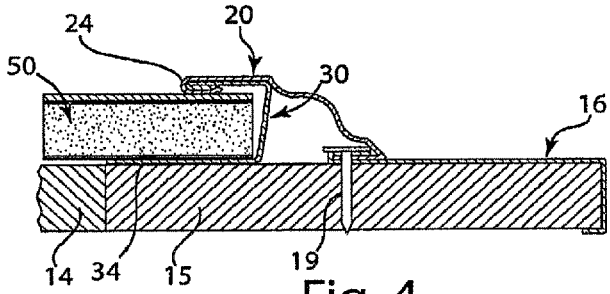
FIG. 4 is a cross-sectional detail of a modification of the preferred embodiment, also taken substantially along the line 2-2 of FIG. 2.

In the embodiment of FIG. 1, the casing face 16 is interengaged with a casing molding generally shown at 20 in FIG. 1. The fold 16*d* formed along the length of the outer periphery of the casing face 16 is interengaged with the casing molding 20. The casing molding 20 includes a web 21 that terminates along one edge in the inwardly extending flange 22 that interlocks with the fold 16*d* formed along the outer edge of the casing face 16. The casing molding 20 includes a web 23 that extends outwardly of the casing face 16 from the fold 16*d*. A loop 24 extends lengthwise of the molding along its outer edge. The web 23 extends away from the casing face 16 at its interengaged end. A spacing 26 between the outer end of the loop 24 (FIG. 4) and the outer surface of the wall 14 is formed to receive siding material 50.

Figure 13:
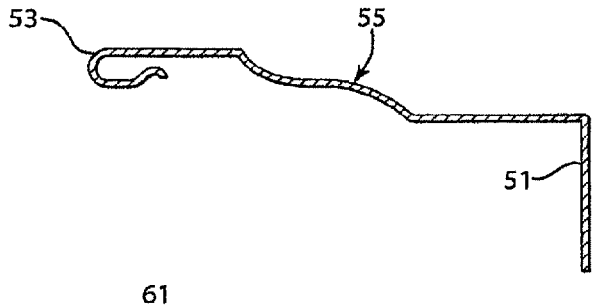
FIG. 13 is a cross-sectional view of a casing face and casing molding combination used for what is characterized in the trade as "brick molding"

The casing web 23 may vary in shape, depending upon the decorative selection as illustrated in the embodiments of FIGS. 2, 3 and 13. In this arrangement, the web is formed with essentially two channels 23*a* and 23*b* (FIG. 3). These channels may vary in width and depth and number. Their specific design is calculated to provide an attractive surface for light impinging on the web and for enhancement of shadows created by sunlight.

The spacing between the loop 24 and the wall 14 provides a space in which the J-shaped channel 30 is positioned. The J-shaped channel 30 has a leg 31 that lies flush against the inner surface of the casing molding with the leg 31 inserted in and frictionally interengaged with the loop 24.

As illustrated in FIG. 3, the loop 24 may be closed to form an essentially re-entrant slot 24*b* that frictionally engages and secures the leg 31 of the J-shaped channel. An outwardly extending leg 34 of the J-shaped channel lies in facing relation to the casing 15 or wall sheathing 14.

The assembly of FIGS. 2 and 3 may be secured by nails 19 which effectively provide a blind nail arrangement.

Figure 5:
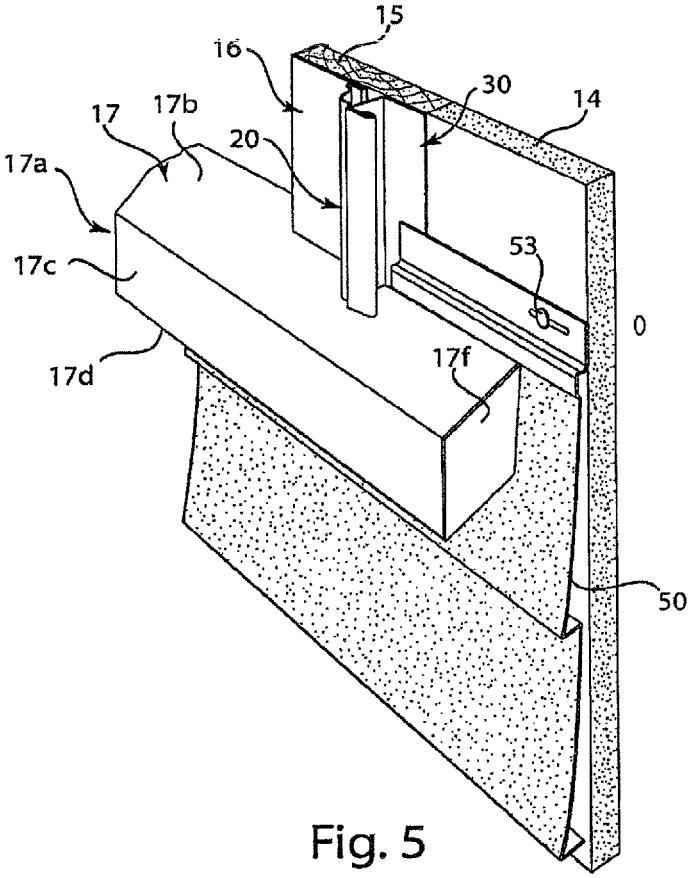
FIG. 5 is a fragmentary, perspective view of a segment of a window and trim assembly embodying the present invention.
Figure 6A:
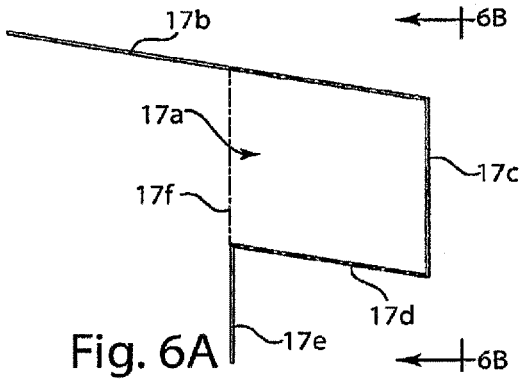
FIG. 6*a* is a cross-sectional detail of a sill cover.
Figure 6B:
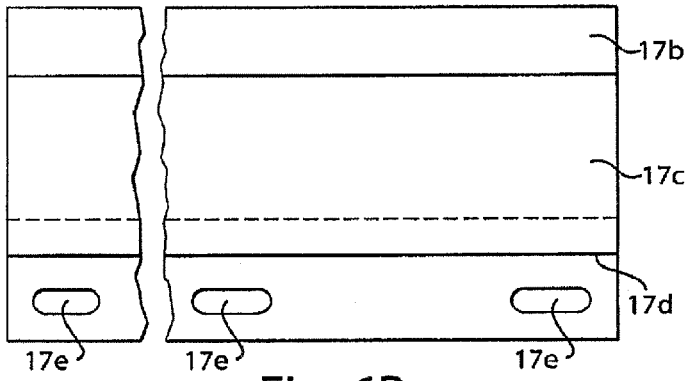
FIG. 6*b* is a top-plan view of the sill cover of FIG. 6*a;*
Figure 7A:
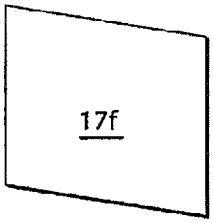
FIG. 7*b* is an end view of the cap of FIG. 7*a*.
FIG. 7*c* is a plan view of the right end of the cap for the end of the sill cover shown in FIG. 6*a*.
Figure 7B:
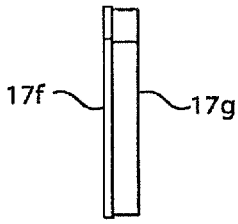
Figure 7C:
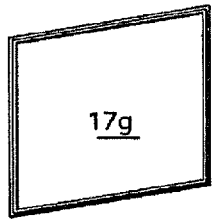

As illustrated in FIG. 5, the J-shaped channel 30 forms a recess at its inner end to receive shingling or siding material 50. The siding material may, as illustrated in FIG. 5, comprise shingles or sheets of vinyl or other plastics or composite construction material shaped to simulate a shingle effect. These sheets are secured by conventional means to the outer wall of the building construction 53.

Figure 8:
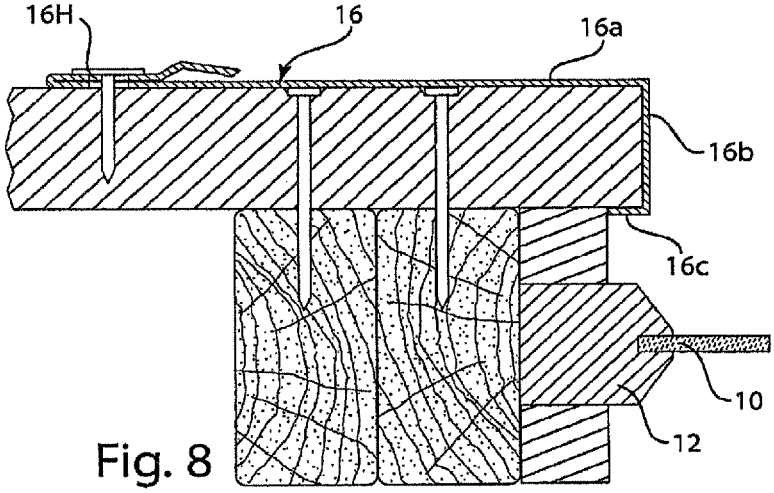
FIG. 8 is a fragmentary, cross-sectional view showing a modified form of a casing face installed in a window frame using a blind nailing technique.
Figure 9:
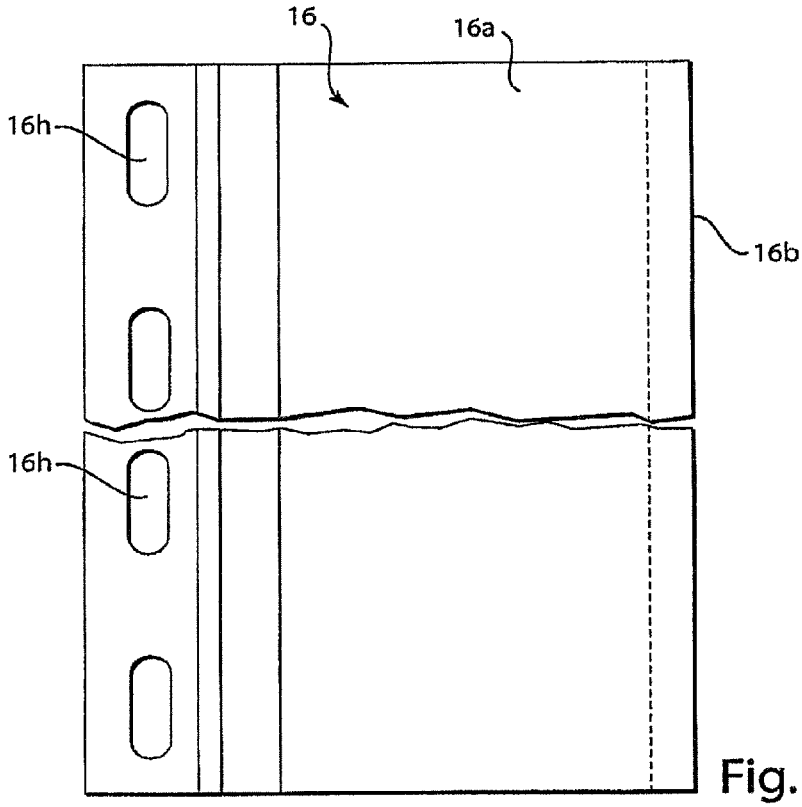
FIG. 9 is a plan view of the casing face shown in FIG. 8.

As noted above, the casing face may be varied in size and styling as exemplified by FIGS. 8 & 9. In this arrangement, the casing face 16 is formed with a web 16*a*, inwardly extending flange 16*b* (into the window opening), and a lip 16*c*. In this arrangement, however, the web 16*a* has a folded end 16H forming a flange engaging member to engage an inwardly extending flange formed near the edge of the casing molding. In place of the folded end 16*h*, an extruded flange 16*d* (FIG. 2) may be used. Suitable nail holes 16*h* may be provided along the length of the facing web 16*a* to secure it to the casing.

Figure 10:
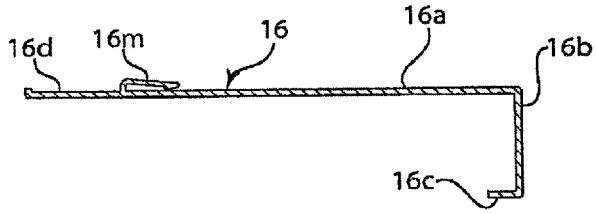
FIG. 10 is a cross-sectional view of a modification of the casing face shown in FIG. 8.

In the embodiment of FIG. 10, the casing face 16 is similar in overall construction to the previously described casing face as provided with an extruded or otherwise similarly formed slot 16*m* to engage an outwardly directed flange of the casing molding in a manner previously described.

Figure 11:
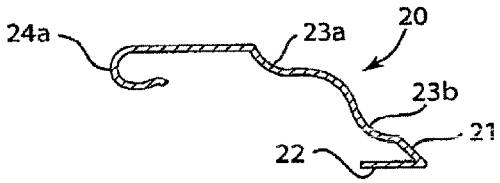
FIG. 11 is a cross-sectional view of a casing molding.
Figure 12:
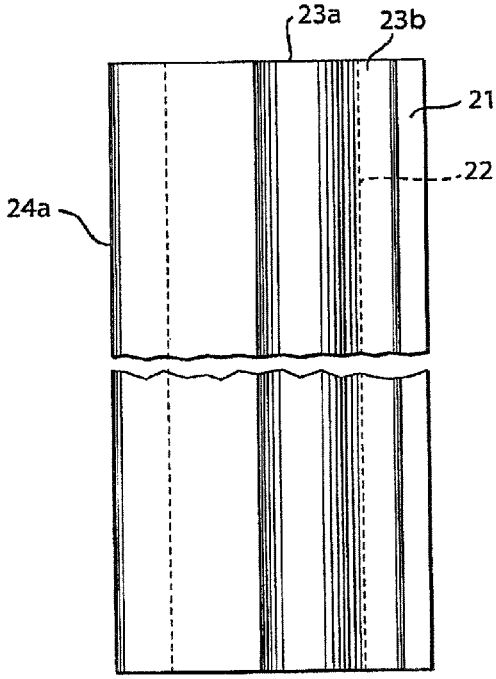
FIG. 12 is a top plan view of the casing molding of FIG. 12.

FIGS. 11 & 12 show a somewhat enlarged view of the casing molding illustrated in FIGS. 2 & 3. In this configuration, the loop 24*a* may be bulbous as shown at 26 in FIG. 2 to provide an interengagement with a corresponding end of the J-channel.

FIG. 13 illustrates a combined or integrated casing face and molding design specifically for what is characterized in the trade as "brick molding" or similar trim configurations on the outside of the building. In this configuration, the portion of the unit forming the casing molding 55 is integrally formed with casing face 57, which trim is shaped to fit over the side of the brick or other substitute wall covering and is secured thereto by nails or the like. The casing facing then is terminated at its other end in a loop 53 which may have a constricted opening to receive and group the edge of the J-channel more securely.

Figure 14:
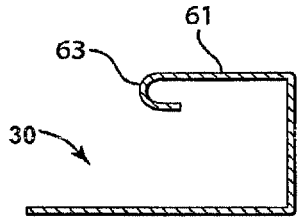
FIG. 14 is a cross-sectional detail of a J-channel used with the casing molding of FIGS. 11 and 13.
Figure 15:
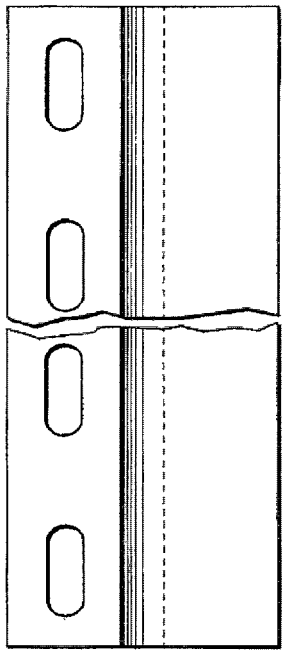
FIG. 15 is a plan view of the J-channel shown in FIG. 14.

FIGS. 14 & 15 show further modifications of the J-channel in which a flange 61 of the J-channel 60 terminates at its free end in a curved loop 63 which may be interlocked with the loop 53 shown in FIG. 13 or similar loops. Similar to the other embodiments siding extends into the J-channel as described in the other embodiments.

Figure 16:
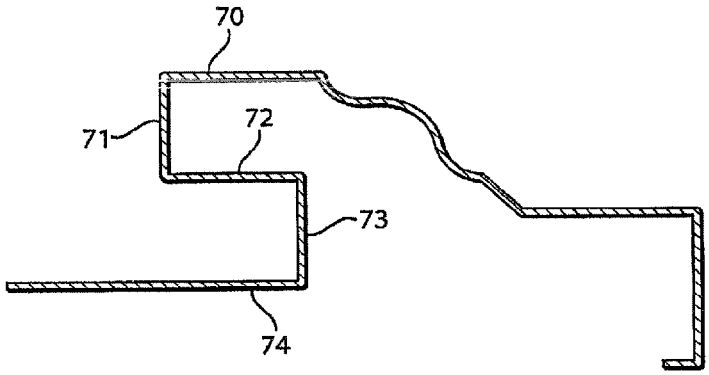
FIG. 16 is a further cross-sectional view of a further modification of the casing molding.

FIG. 16 illustrates a still further embodiment of a modified shape for the casing molding in which the outwardly extending flange 70 terminates in an S-shaped segment having legs 71, 72, 73, and 74 in which the base of the J-shaped channel may be secured.

The casing face 16, casing molding 20 and J-channel 30 may each be made for a trim kit package adapted for on-site fabrication. In this arrangement, these components may be formed as extruded plastic or bent metal components having lengths, such as 20' that will exceed the dimensions of the fenestration. On site they are cut to fit the particular installation using well-known techniques for installing window components.

As used in this specification the terms inward or inwardly, unless otherwise expressly stated, means in a direction parallel, or essentially parallel, to the major surface of the casing and construction wall toward the fenestration, and outwardly refers to the opposite direction.

While aspects of the invention have been described with reference to various illustrative embodiments, such aspects are not limited to the embodiments described. Thus, it is evident that many alternatives, modifications, and variations of the embodiments described will be apparent to those skilled in the art. Accordingly, embodiments as set forth herein are intended to be illustrative, not limiting. Various changes may be made without departing from the spirit of aspects of the invention.

What is claimed is:

1. A frame assembly for a fenestration opening defined by a casing comprising:

a casing facing covering at least a portion of the casing;

a J-channel secured to the casing and about the periphery of the opening and defining a channel facing outwardly of the opening;

siding material with edges of the siding material extending into the outwardly facing channel; and an elongated casing molding with one longitudinal edge engaging the casing facing and a second longitudinal edge, non-planar with the one longitudinal edge, engaging one longitudinal edge of the J-channel, wherein the second longitudinal edge and the one longitudinal edge of the J-channel extend outwardly over a surface of the siding material facing away from the casing in a direction substantially parallel to a longer side of the material; and wherein each of the casing facing, the J-channel, and the casing molding include a plastic material.

2. The frame assembly of claim 1 wherein the elongated casing molding for attachment to a frame assembly is defined by an elongated body having a pair of longitudinally extending flanges substantially parallel to one another with one flange extending inwardly from one side edge of the molding body and the other extending outwardly from the other side edge of the molding body with the two flanges displaced from each other.

3. The frame assembly of claim 2 wherein the elongated casing molding has a constant cross-section along a major portion of its length and with the casing molding having the pair of flanges extending therefrom in horizontally displaced planes with one flange to be secured to a casing and the other shaped to engage a J-channel.

4. A frame assembly as set forth in claim 1 wherein the casing facing and casing molding are each integrally formed.

5. A frame assembly as set forth in claim 1 wherein the casing facing and J-channel are of a color contrasting with the color of the casing molding.

6. A frame assembly as set forth in claim 5 wherein the casing molding has a cross-section defining an intermediate portion of grooves that when assembled are capable of defining shadows of impinging light.

7. A frame assembly as set forth in claim 6 wherein the assembly defines a rectangular opening framing a window.

8. A frame assembly as set forth in claim 1 wherein the frame assembly is for a window fenestration.

9. A frame assembly as set forth in claim 1 wherein the frame assembly is for a door fenestration.

10. A casing molding as set forth in claim 1 wherein the casing molding is formed of an extruded material in lengths of on the order of at least about four feet, and in which the material of the casing has a resiliency sufficient to permit selective flexing of the casing molding during installation.

11. A frame assembly as set forth in claim 1 with the casing molding having one interlocking mechanism for interengaging the casing molding and the casing face and a second interlocking mechanism interengaging the casing molding and the J-channel.

12. A frame assembly as set forth in claim 1 wherein the casing facing and casing molding are each integrally formed.

13. The frame assembly as set forth in claim 1, wherein the plastic material is vinyl.

14. A frame assembly for a fenestration opening defined by a casing comprising:

a casing facing covering at least a portion of the casing;

a J-channel secured to the casing and about the periphery of the opening and defining a channel facing outwardly of the opening;

siding material with edges of the siding material extending into the outwardly facing channel; and an elongated casing molding having a pair of longitudinally extending flanges substantially parallel to a longer side of the siding material with one flange extending inwardly from a first side edge of the casing molding and secured to the casing facing and the other extending outwardly from a second side edge of the casing molding and secured to the J-channel;

wherein each of the casing facing, the J-channel, and the casing molding include a plastic material.

15. The frame assembly of claim 14, wherein the elongated casing molding has a constant cross-section along a major portion of its length and with the casing molding having the pair of flanges extending therefrom in horizontally displaced planes.

16. A frame assembly as set forth in claim 14 wherein the casing facing and casing molding are each integrally formed.

17. The frame assembly of claim 14, wherein the plastic material is vinyl.

18. A frame assembly for a fenestration opening defined by a casing comprising:

a casing facing covering at least a portion of the casing;

a J-channel secured to the casing and about the periphery of the opening and defining a channel facing outwardly of the opening; and an elongated casing molding with one longitudinal edge engaging the casing facing and a second longitudinal edge, non-planar with the one longitudinal edge, engaging one longitudinal edge of the J-channel, wherein the second longitudinal edge extends outwardly of the opening around the longitudinal edge of the J-channel and inwardly toward the outwardly facing channel, the second longitudinal edge being adjacent to a longer side of a siding material;

wherein the second longitudinal edge and the longitudinal edge of the J-channel extend in a direction substantially parallel to the longer side of the siding material;

wherein each of the casing facing, the J-channel, and the casing molding include a plastic material.

19. A frame assembly as set forth in claim 18 further comprising siding material with edges of the siding material extending into the outwardly facing channel.

20. The frame assembly of claim 19, wherein the elongated casing molding has a constant cross-section along a major portion of its length and with the casing molding having the pair of flanges extending therefrom in horizontally displaced planes.

21. The frame assembly of claim 18 wherein the elongated casing molding for attachment to a frame assembly is defined by an elongated body having a pair of longitudinally extending flanges substantially parallel to one another with one flange extending inwardly from one side edge of the molding body and the other extending outwardly from the other side edge of the molding body with the two flanges displaced from each other.

22. A frame assembly as set forth in claim 18 wherein the casing facing and casing molding are each integrally formed.

23. The frame assembly of claim 18, wherein the plastic material is vinyl.

* * * * *

UNITED STATES PATENT AND TRADEMARK OFFICE

CERTIFICATE OF CORRECTION

PATENT NO. : 8,511,012 B2
APPLICATION NO. : 12/851298
DATED : August 20, 2013
INVENTOR(S) : Richard Scalzi It is certified that error appears in the above-identified patent and that said Letters Patent is hereby corrected as shown below:

In the Claims

In claim 1, at column 5, line 8, before the word material please insert the word -- siding --.

In claim 12, at column 5, line 52, please delete "each integrally formed" and insert -- an integrally formed member --.

Signed and Sealed this
Fifteenth Day of July, 2014

Michelle K. Lee

Michelle K. Lee
*Deputy Director of the United States Patent and Trademark Office*